US010199776B2

(12) United States Patent
Cheng et al.

(10) Patent No.: US 10,199,776 B2
(45) Date of Patent: Feb. 5, 2019

(54) ELECTRICAL CONNECTOR WITH IMPROVED SHIELDING PLATE

(71) Applicant: FOXCONN INTERCONNECT TECHNOLOGY LIMITED, Grand Cayman (KY)

(72) Inventors: Chih-Pi Cheng, New Taipei (TW); Wen He, Shenzhen (CN); Quan Wang, Shenzhen (CN); Yang Qu, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/632,396

(22) Filed: Jun. 26, 2017

(65) Prior Publication Data

US 2017/0331229 A1 Nov. 16, 2017

Related U.S. Application Data

(63) Continuation-in-part of application No. 15/487,405, filed on Apr. 13, 2017, which is a continuation-in-part of application No. 15/135,487, filed on Apr. 21, 2016.
(Continued)

(30) Foreign Application Priority Data

Apr. 21, 2015 (CN) ..... 2015 2 0242634 U
Apr. 13, 2016 (CN) ..... 2016 1 0225997
(Continued)

(51) Int. Cl.
*H01R 13/658* (2011.01)
*H01R 13/6585* (2011.01)
*H01R 13/6594* (2011.01)
*H01R 24/60* (2011.01)
*H01R 24/62* (2011.01)
*H01R 107/00* (2006.01)
(Continued)

(52) U.S. Cl.
CPC ..... *H01R 13/6585* (2013.01); *H01R 13/6594* (2013.01); *H01R 24/60* (2013.01);
(Continued)

(58) Field of Classification Search
CPC ..... H01R 13/6585; H01R 13/6582
See application file for complete search history.

(56) References Cited

U.S. PATENT DOCUMENTS 9,093,779 B1 7/2015 Wang et al.
9,281,626 B2 * 3/2016 Lin ..... H01R 13/6581
(Continued)

FOREIGN PATENT DOCUMENTS

CN 103035266 A 4/2013
CN 203859275 U 10/2014
(Continued)

*Primary Examiner* — Felix O Figueroa
(74) *Attorney, Agent, or Firm* — Wei Te Chung; Ming Chieh Chang

(57) ABSTRACT

An electrical connector includes a terminal module including an insulating housing, a plurality of terminals and a shielding plate. The insulating housing defines a base and a mating tongue extending from the base, the mating tongue defines opposite mating surfaces, a front face and opposite side faces connecting with the mating surfaces and the front face. The terminals include contacting sections exposed upon the mating surfaces and leg sections out of the base. The shielding plate is embedded in the insulating housing and includes a main portion disposed between the mating surfaces and two thickened side portions, the side portions enclose opposite side faces of the mating tongue and each provides a side latch at an outer side face thereof. The side portions extend forward to the front face of the mating tongue and rearward to the base.

17 Claims, 14 Drawing Sheets

Related U.S. Application Data

(60) Provisional application No. 62/333,161, filed on May 7, 2016.

(30) Foreign Application Priority Data

May 10, 2016 (CN) ..... 2016 1 0304625
Jun. 24, 2016 (CN) ..... 2016 1 0467030

(51) Int. Cl.
*H01R 12/72* (2011.01)

(52) U.S. Cl.
CPC ..... *H01R 24/62* (2013.01); *H01R 12/721* (2013.01); *H01R 2107/00* (2013.01)

(56) References Cited

U.S. PATENT DOCUMENTS 9,281,643 B1 * 3/2016 Tseng ..... H01R 13/518
9,300,095 B2 * 3/2016 Lin ..... H01R 24/60
9,490,595 B2 * 11/2016 Little ..... H01R 13/6594
9,496,664 B2 * 11/2016 Little ..... H01R 13/6587
9,843,148 B2 * 12/2017 Little ..... H01R 24/60
9,847,614 B1 * 12/2017 Wu ..... H01R 24/64
2015/0093936 A1 * 4/2015 Little ..... H01R 13/6583 439/607.19
2015/0244111 A1 8/2015 Ju et al.
2015/0295362 A1 * 10/2015 Tziviskos ..... H01R 13/6581 439/607.01

FOREIGN PATENT DOCUMENTS

CN 104518346 A 4/2015
CN 204315776 5/2015
CN 204441556 7/2015
CN 104836051 A 8/2015
CN 204696302 10/2015
CN 204760596 U 11/2015
CN 105356109 A 2/2016
CN 105470782 4/2016
CN 205159614 U 4/2016

* cited by examiner

ELECTRICAL CONNECTOR WITH IMPROVED SHIELDING PLATE

BACKGROUND OF THE INVENTION

1. Field of the Invention

The present invention relates to an electrical connector with an improved shielding plate and the improve shell.

2. Description of Related Art

CN Patent Issued No. 203859275U disclose a USB Type C connector which includes a first terminal module, a second terminal module and a shielding plate sandwiched between the first and second terminal modules to electrically isolate the first and second terminals. The shielding plate forms a cutting surface at lateral sides thereof which are defined as side latches. The shielding plate has a thickness less than 0.02 mm. It is believed that the side latches of the shielding plate will scrap a pair of plug latches of a mating connector. Moreover, the plug latch will wear the insulating mating tongue fitly surrounding the terminals and the shielding plate.

In view of the above, an improved electrical connector is desired to overcome the problems mentioned above.

SUMMARY OF THE INVENTION

Accordingly, an object of the present disclosure is to provide a an electrical connector with an improved shielding plate.

According to one aspect of the present disclosure.

Other objects, advantages and novel features of the disclosure will become more apparent from the following detailed description when taken in conjunction with the accompanying drawings.

DETAILED DESCRIPTION OF THE INVENTION

Reference will now be made to the drawings to describe a preferred embodiment of the present disclosure in detail.

Figure 1:
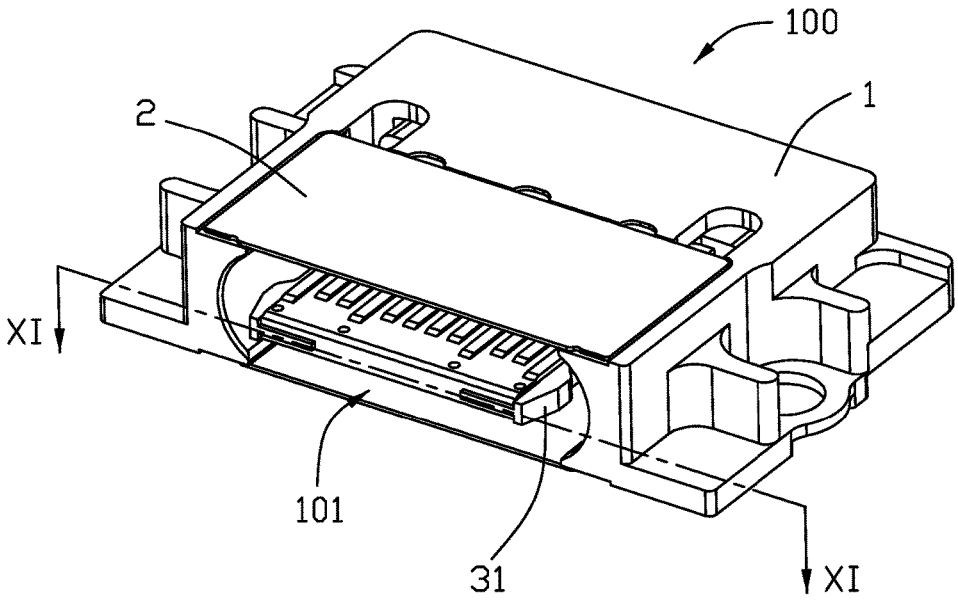
FIG. 1 is a front perspective view of an electrical connector in accordance with a preferred embodiment of the present invention.
Figure 2:
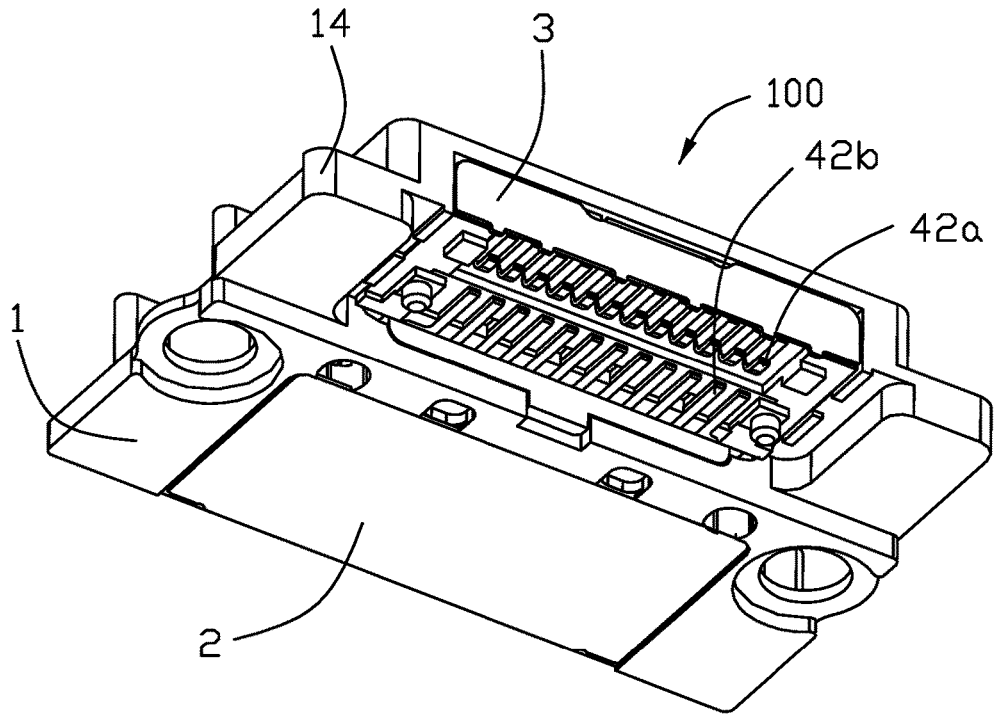
FIG. 2 is a bottom perspective view of the electrical connector in FIG. 1.

Referring to FIGS. 1 and 2 illustrating a low profile electrcia connector 100 which is a receptacle connector mounted on a printed circuit board (PCB, not shown) assembled in an electronic equipment (not shown), for being inserted with a plug connector (not shown). The receptacle connector 100 comprises a casting outer case 1, a pair of shielding sheets 2 fixed on the case 1 and a terminal module 3 retained in the case 1.

Figure 3:
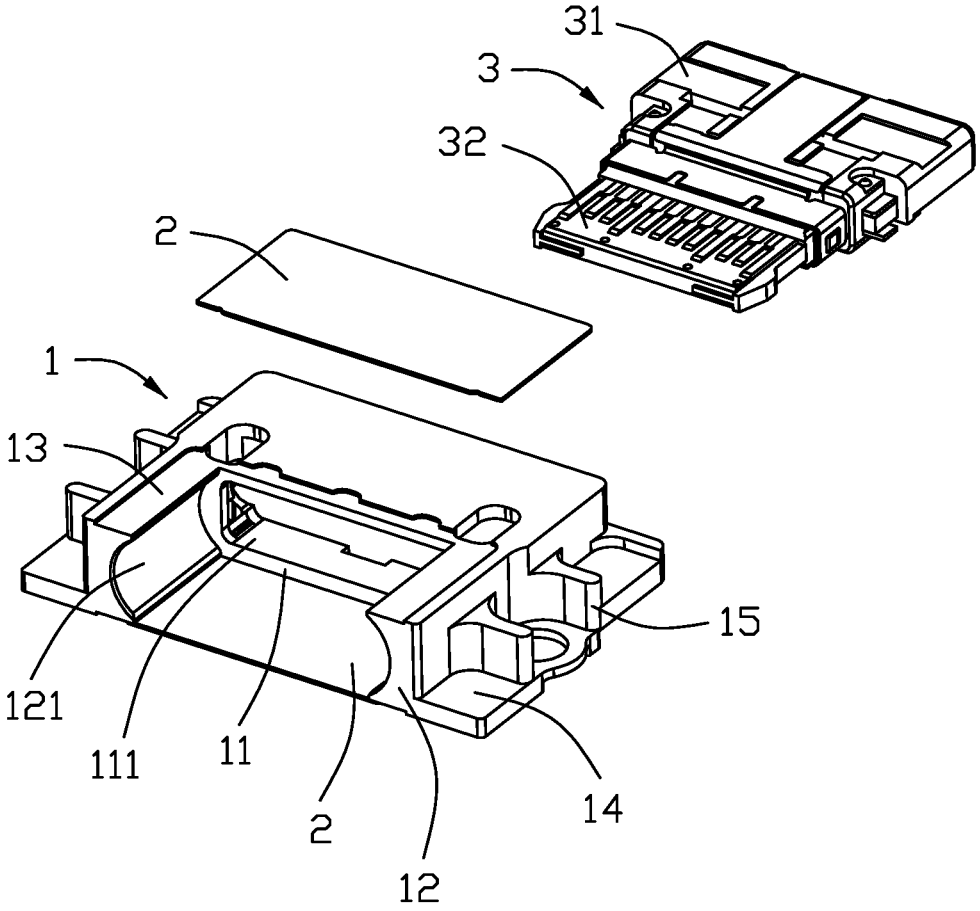
FIG. 3 is a top exploded perspective view of the electrical connector in FIG. 1.
Figure 4:
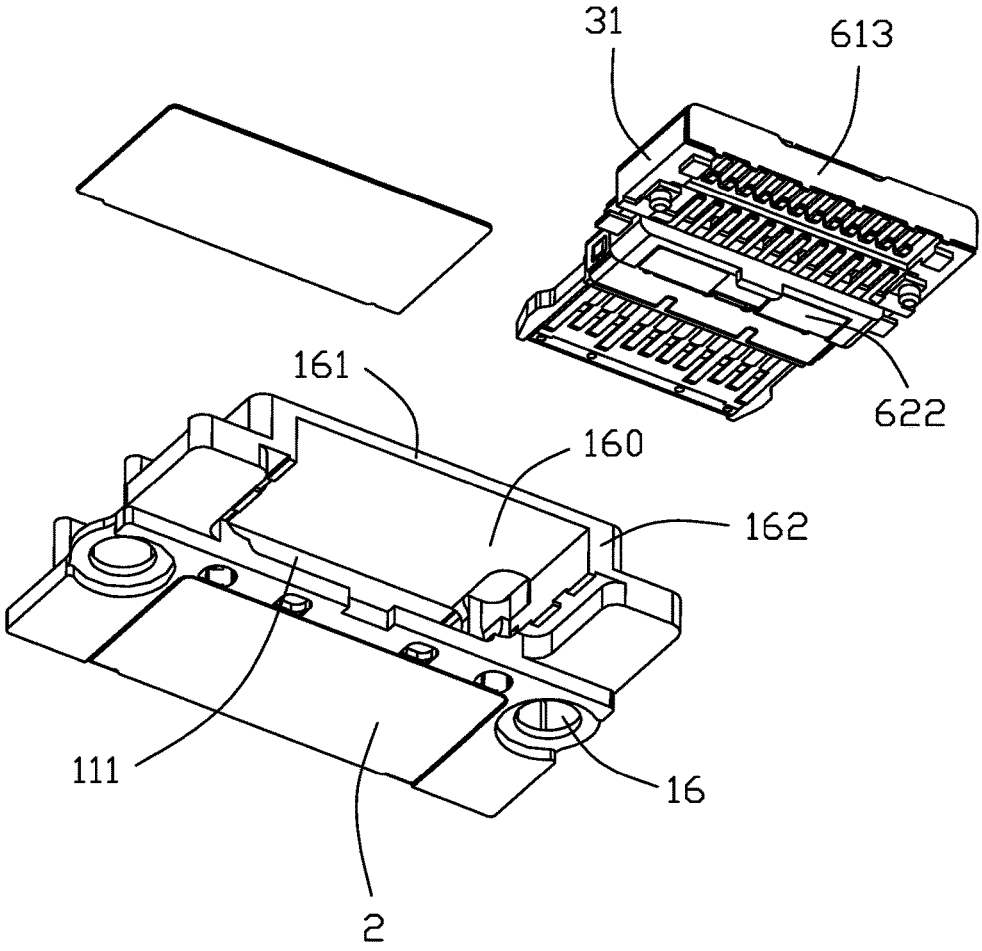
FIG. 4 is a bottom exploded perspective view of the electrical connector in FIG. 2.

Referring to FIGS. 3 and 4, the terminal module 3 includes a base 31 and a mating tongue 32 extending forward from the base 31. The case 1 includes a vertical base wall 11 and two side walls 12 extending forward from two lateral sides of the base wall 11, the base wall 11 defines a retained slot 111 through which the terminal module 3 goes. Please notes, there is no upper and lower walls connecting between the two side walls 12. The shielding sheets 3 cover on the upper and lower sides of the side walls 12 and the base wall 11, so as to commonly define a mating cavity 101 (labeled in FIG. 1), the mating tongue 32 extending into the mating cavity 101 and the insides 121 of the side walls 12 are in an arc-sharp which is comply with the definition of USB Type-C specification. The shielding sheets 2 are laser-soldered to the case 1 and the case 1 is made via metal injection molding process thereby getting a good strength. The case 1 without any upper and lower wall around the mating port will reduce occupancy of the case in the electronic equipment in a vertical direction. Notably, the electrical connector is located around the edge portion of the cellular enclosure which is relative thinner than the main portion of the cellular enclosure. The separate shielding sheets 2 assembled to the case 1 overcome leakage of magnetism. In this preferred embodiment, the two shielding sheets 2 are pre-positioned in shallow recess 13 defined on the case 1 and then laser-welded to the case 1. And then the terminal module 3 is inserter forward through the retained slot 111. Alternatively, the shielding sheets 2 are welded after the terminals module 3 is inserted.

The case 1 further defines mounting wings 14 horizontally extending outward from the lower edges of the outer sides of the side walls 12 and two vertical ribs 15 on each the upper face of mounting wings 14. Each of mounting wings 14 defines a through hole 16 between the two ribs 15, a retaining element such as screws (not shown) can retain the case 1 in the electronic equipment via the through holes 16. The case 1 further defines an upper wall 161 and two side walls 162 extending rearward from the base wall 11, so as to define a receiving cavity 160 thereamong in which the base 31 is retained and received as best shown in FIG. 2.

Figure 5:
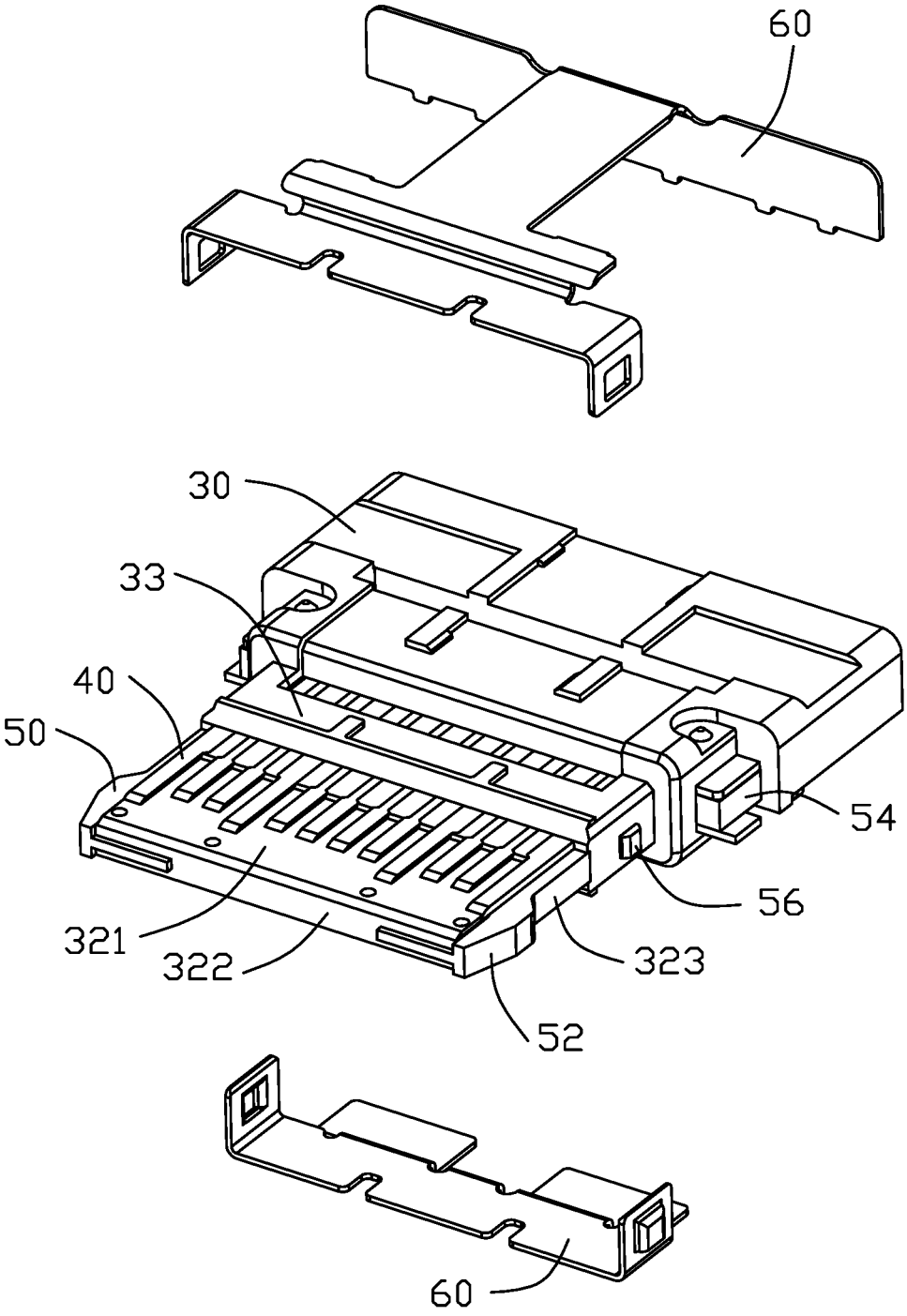
FIG. 5 is a top exploded perspective view of the terminal module in FIG. 3.
Figure 6:
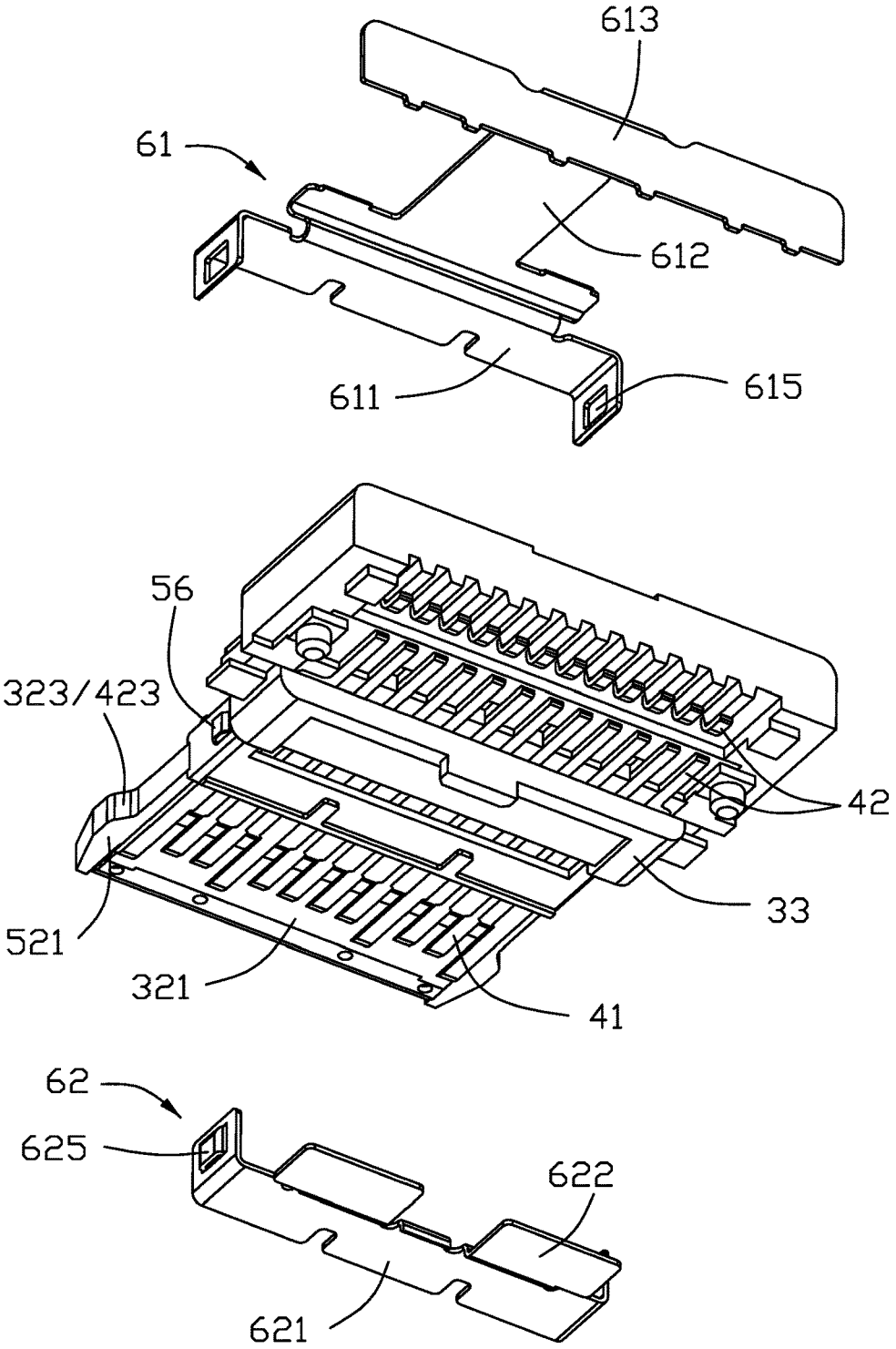
FIG. 6 is a bottom exploded perspective view of the terminal module in FIG. 4.
Figure 9:
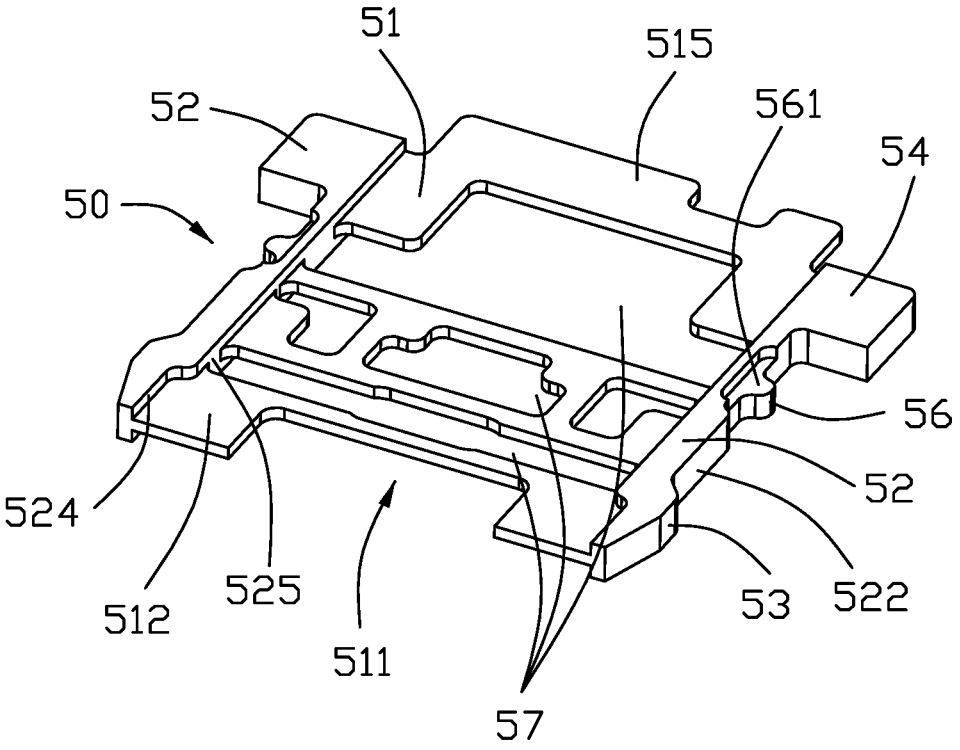
FIG. 9 is a top perspective view of the shielding plate.
Figure 10:
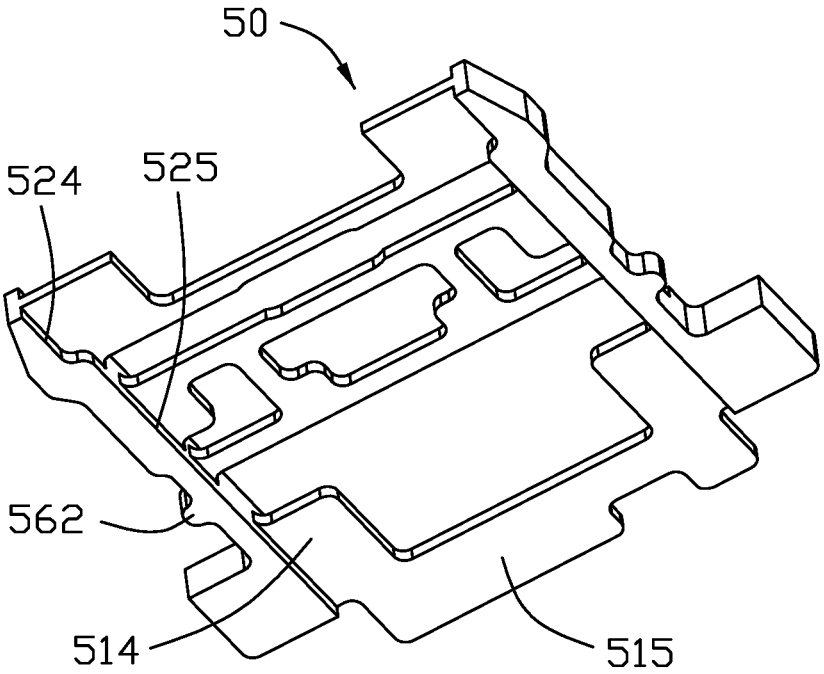
FIG. 10 is a bottom perspective view of the shielding plate.

Referring to FIGS. 5 and 6, the terminal module 3 comprises an insulative housing 30, conductive terminals 40, a shielding plate 50 and a pair of shielding collars 60. The housing 30 includes the base 31 and mating tongue 32 defining two opposite mating surfaces 321 and a front face 322 and two side faces 323 connecting with the mating surfaces 321 and the front face 322. The terminals 40 includes contacting portions 41 exposed upon the mating surfaces 321 and leg portions 42 extending out of the base 31. Referring to FIGS. 9 and 10, the shielding plate 50 made of forging or die-casting, includes a main portion 51 and two side portions 52 at opposite lateral sides of the main portion 51, the side portions 52 are thicker than the main portions 51 along the vertical direction perpendicular to the shielding plate 50. The main portion 51 defines a longitudinal slot 511 running through a front area thereof, so that remaining portions 512 are defined between the longitudinal slot 511 and side portions 52. The inside faces 524 of the two side portions corresponding to the longitudinal slot 511 has a lager distance than that between the inside faces 525 of other portions of the two side portions 52. The main portion 51 includes a front area 514 located between the two side portions 52 and a rear area 515 behind the side portions 52. The shielding plate is formed by die cast.

Figure 7:
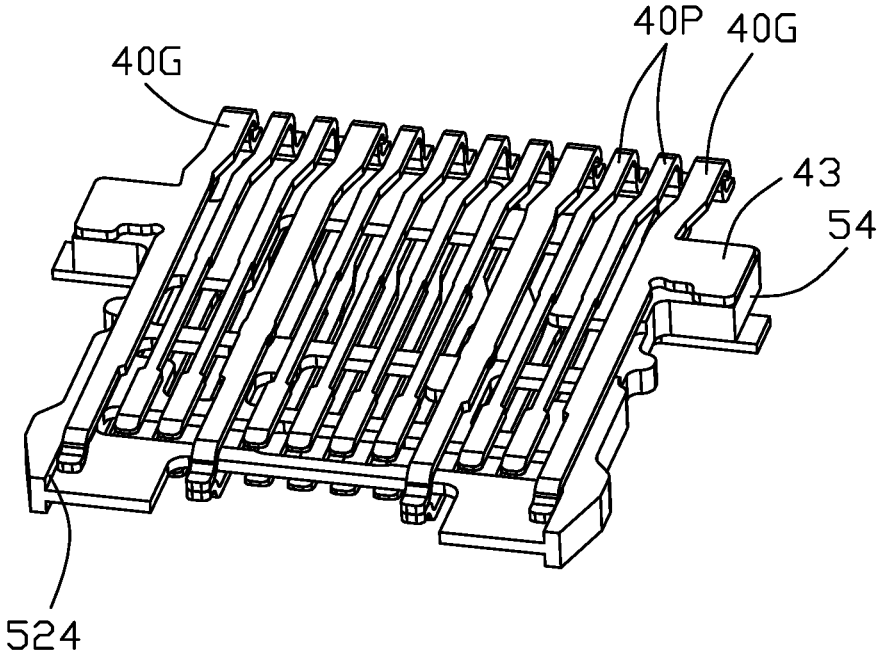
FIG. 7 is a top perspective view of first terminals and a first insulator.
Figure 8:
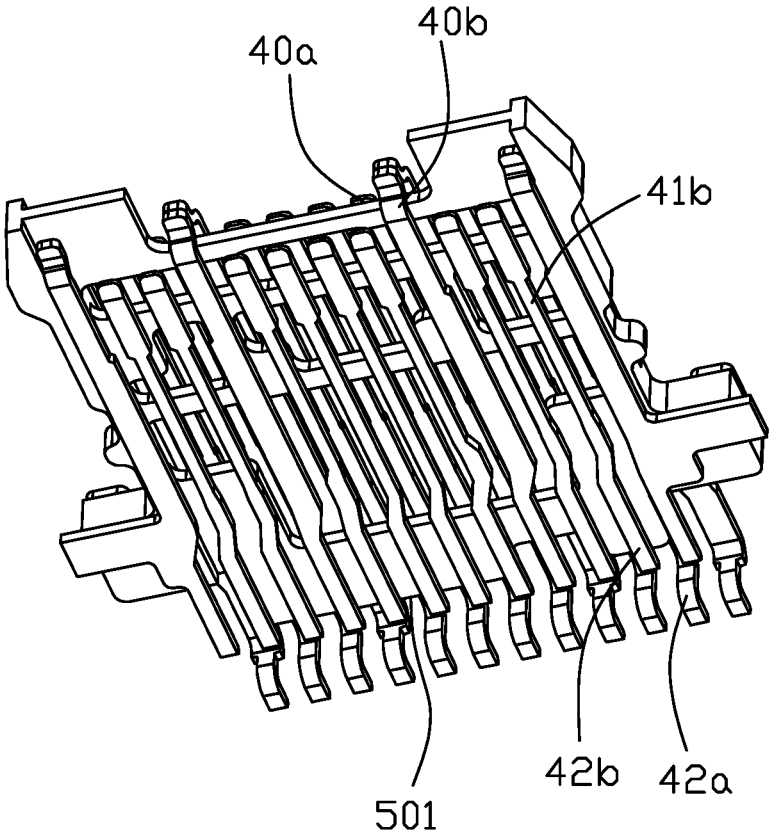
FIG. 8 is a bottom perspective view of the first terminals and the first insulator.

Referring to FIGS. 7 and 8, the side portions 52 defines rear wings 54 laterally protruding outward from a rear edge thereof. The terminals 30 consist of signal terminals, power terminals 40P and grounding terminals 40G, the grounding terminals 40G are located at outermost position and have tabs 43 touching the corresponding lateral wings 43. Meanwhile, the grounding terminals 40G are located beside the side portions 52 and laterally contact the inside faces 524, 525 of the side portions side-by-side. The terminals are categorized with a row of first terminal 40*a* and a row of second terminals 40*b*, the leg portions 42*a* of the first terminals extend from the contacting portions and then bend downward, while the leg portions 42*b* located inside of the leg portions 42*a*, are in a same level of the contacting portions 41*b* of the second terminals 40*b*. The rear edges 501 of the side portions extend near to the leg portions 42*b*.

Figure 11:
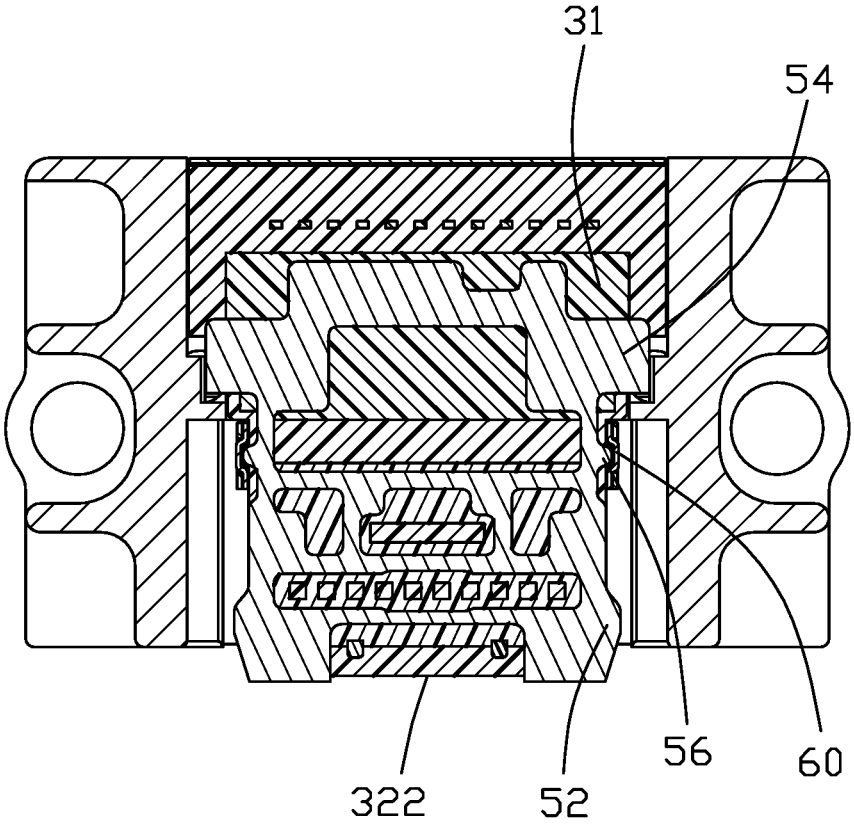
FIG. 11 is a cross-sectional view of the electrical connector along lines 11-11 in FIG. 11.

Referring to FIG. 6, each side portion 52 defines opposite mating faces 521 which construct parts of the mating surfaces 321 of the mating tongue 32 thereby complete the mating surfaces 321, and an outer side face 522 connecting with the mating faces 521. The side portions 52 define side latches 53 at the outer side faces 522. As best shown in FIG. 11, the side portions 52 extend forward to the front face 322 and rearward to the base 31, the lateral wings 54 laterally protrude the base 31. Meanwhile, a boss portion 56 laterally protrudes from each side portion 52. The upper face 561 of the boss portion 56 are lower than the upper face of the side portions 52, while the lower faces 562 of the boss portion 56 and the side portions are located at a same plane. The upper face 561 avoids interfering with ends of the collar 60.

Referring to FIGS. 5 and 6, the mating tongue 32 defines a thickened portion 33 at a root thereof near the base 31, and the pair of collars 60 surrounding the outer periphery of the thickened portion 33 and the boss portions 56 contact the collars 60. The upper collar 61 includes a cover portion 611, a rear wall 613 covering the rear face of the base 31 as shown in FIG. 4 and a connecting portion 612 connecting with the cover portion 611 and the rear wall 613. The lower collar 62 includes a cover portion 621 and a touching portion 622 extending rearward from the cover portion. Combination with FIG. 2, the touching portion 622 stick the inside face of the retaining slot 111 of the base wall 11, so that a grounding trace is form between the touching portion 622 and the case 1. The two cover portions 611, 621 define locking holes 615 and locking dimples 625 which two are engaged with each other at opposite ends thereof, and the boss portions 56 are locked in opposite recesses of the locking dimples 624 as best shown in FIG. 11. Therefore, the pair of collars 60 is retained around the thickened portion 33. Combination with FIG. 2, the leg portions of the two rows are located in a same plane to be mounted on the printed circuit board.

Figure 12:
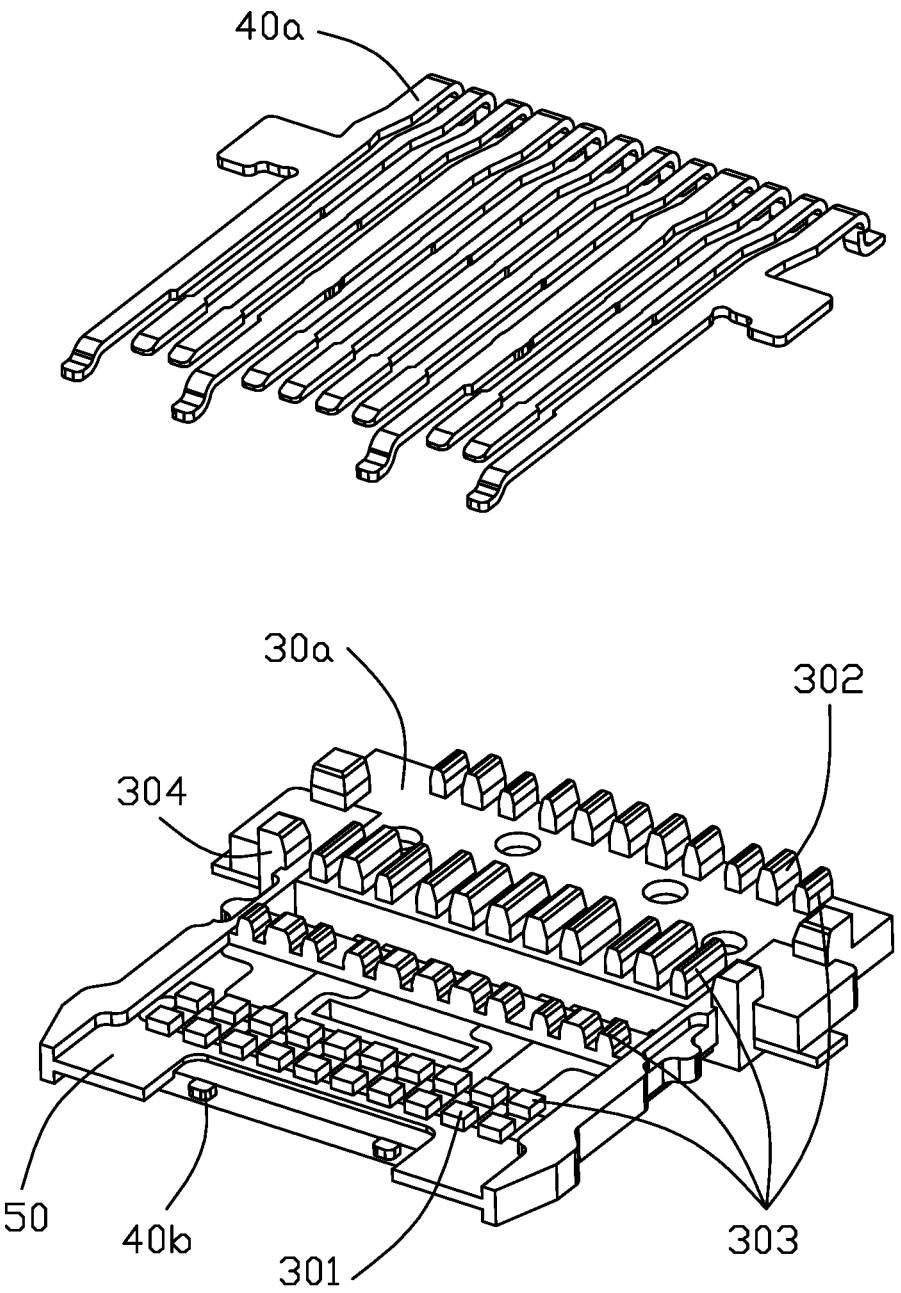
FIG. 12 is a top exploded perspective view of first terminals and the first insulator.
Figure 13:
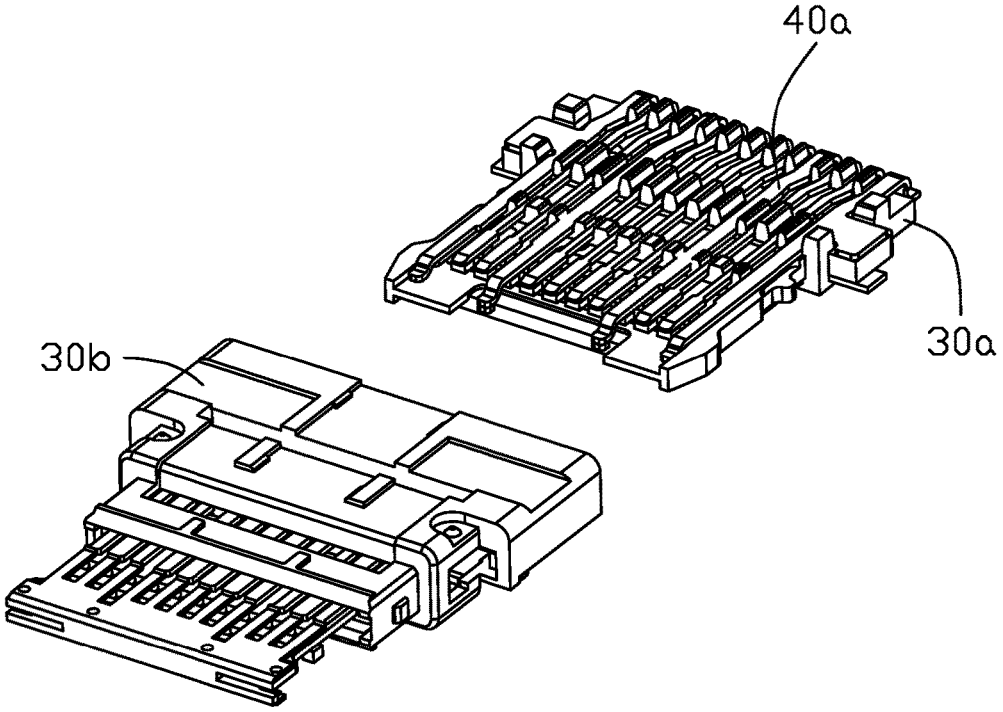
FIG. 13 is a top exploded perspective view of a second insulator and the first insulator assembled with the first and second terminals.
Figure 14:
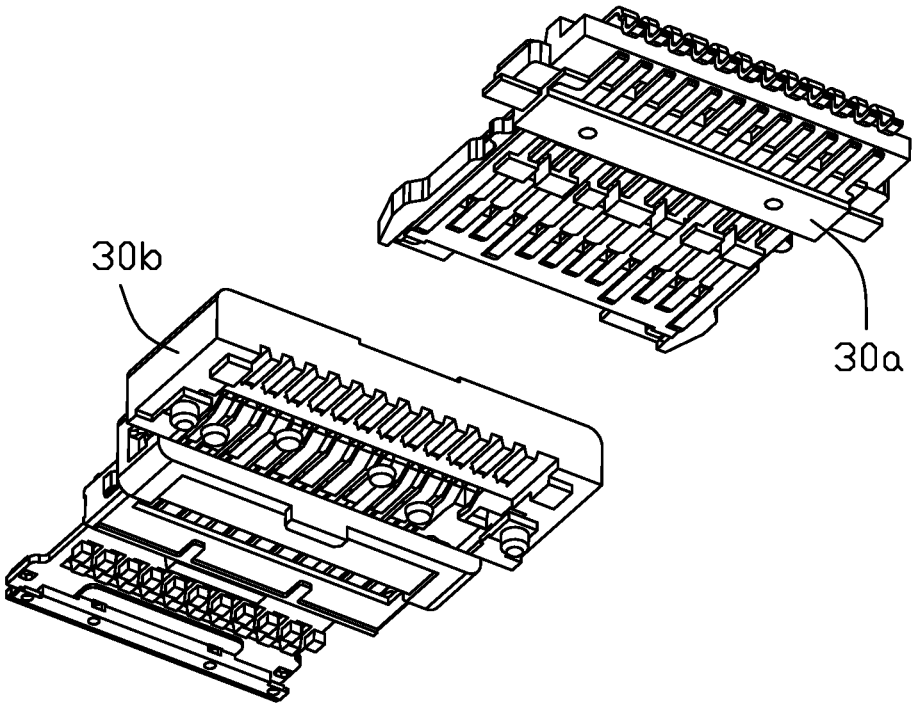
FIG. 14 is a bottom exploded perspective view of the second insulator and the first insulator assembled with the first and second terminals.

Referring to FIG. 12, the shielding plate 50 and the row of second terminals 40*b* initially are molded in a first insulator 30*a* via a first inserting molded process, and successively the row of first terminals 40*a* are assembled on the upper surface of the first insulator 30*a*. Since the thickened side portions 52 is strong and long enough to support the first insulator 30*a* without risks of self-twisting which may happen in the traditional stamped/planar type shielding plate. This is especially true when the shielding plate is required to form some openings for allowing to be insert-molded with the contacts in the first insulator. The traditional stamped/planar type shielding plate may tend to be deflected during manufacturing if many holes are formed in the shielding plate for consideration of insert-molding with the contacts within the insulator. The first insulator 30*a* consists of a front part 301 and a rear part 302 since resin materials are filled in from two points in the front and rear direction and through slots 57 opened in the shielding plate 50. The upper face of the first insulator defines three rows of ribs 303 thereon and the rear part 302 defines a post 304 at a front edge thereof. And then, a second insulator 30*b* are molded to surround the row of first terminals 40*a* and the first insulator 30*a*, thereby commonly forming the insulating housing 30 as shown in FIG. 5. The shielding collars 60 are assembled on the insulating housing 30 thereby forming the terminals module 3 as shown in FIG. 3. Lastly, the terminal module 3 is assembled in the metallic case 1 thereby forming the receptacle connector 100. As understood, the case 1 is made of die-casting or metal injection molding with thickened structures for superior rigidity thereof. Anyhow, on one hand, the height of the whole connector is a concern for use within a cellular phone so as to remove the top wall and the bottom wall around the mating port; on the other hand, the EMI shielding should be complete so as to provide the relatively thinner shielding sheet 2 attached thereto to replace the originally removed top wall and bottom wall Therefore, another feature of the invention is to have the case made of metal injection molding or die-casting and equipped with additional opposite shielding sheets on the top and the bottom to form a hybrid type case, i.e., the die-casting of the case itself and the stamping of the shielding sheet.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector comprising:

a terminal module comprising an insulating housing, two rows of terminals and a metallic shielding plate;

the insulating housing defining a base and a mating tongue extending from the base, the mating tongue defining opposite mating surfaces, a front face and opposite side faces connecting with the mating surfaces and the front face;

the two rows of terminals comprising contacting sections exposed upon the mating surfaces and leg sections out of the base;

the shielding plate embedded in the insulating housing and comprising a main portion disposed between the two rows of terminals and two thickened side portions, wherein the side portions enclose opposite side faces of the mating tongue and each provides a side latch at an outer side face thereof, the side portions extend forward to the front face of the mating tongue and rearward to the base so that rear ends of the side portions are embedded in the base;

wherein the terminals comprise grounding terminals located at outermost positions and laterally touching inside faces of the side portions.

2. The electrical connector as claimed in claim 1, wherein the side portions approach the leg portions.

3. The electrical connector as claimed in claim 1, wherein the main portion of the shielding plate defines a longitudinal slot running through a front area thereof and a remaining portion between the longitudinal slot and the side portion, inside faces of the two side portions corresponding to the longitudinal slot has a lager distance than that between inside faces of other portions of the two side portions.

4. The electrical connector as claimed in claim 1, wherein the main portion comprises a front area between the side portions and a rear area behind the side portions.

5. The electrical connector as claimed in claim 1, wherein the shielding plate defines rear wings extending from rear edges of the side portions, the terminals comprise grounding terminals which have tabs touching the corresponding lateral wings.

6. The electrical connector as claimed in claim 1, wherein the mating tongue defines a thickened portion at a root thereof near the base, and a pair of shielding collars surrounding an outer periphery of the thickened portion and the shielding plate defines boss portions laterally protruding and contacting the shielding collars.

7. The electrical connector as claimed in claim 1, wherein the terminals are categorized with a row of first terminal and a row of second terminals, the leg portions of the first terminals extend from the contacting portions and then bend downward, while the leg portions of the second terminals are located in front of the leg portions of the first terminals and are in a same level of the contacting portions of the second terminals.

8. The electrical connector as claimed in claim 1, comprising an outer case and a pair of shielding sheets, wherein the outer case comprises a base wall with a retaining slot and two side walls extending forward from the base wall, the mating tongue of the terminal module go through the retaining slot and the base is retained in the retaining slot, the shielding sheets are mounted on an upper face and a lower face of the side walls thereby defining a mating cavity among the side walls, the shielding sheet and the base wall.

9. The electrical connector as claimed in claim 8, wherein the case comprises a top wall and two side walls extending forward from the base wall, thereby commonly defining a receiving cavity.

10. The electrical connector as claimed in claim 1, wherein the terminals are categorized with a row of first terminal and a row of second terminals, the insulating housing comprising a first insulator and a second insulator, the second terminals are molded in the first insulator and the first terminals are assembled on the first insulator and then the second insulator are molded on the second terminals and the first insulator.

11. An electrical connector comprising:

a die-cast outer case comprising a vertical base wall with a retaining slot, two front side walls extending forward from the base wall, and a top wall and two rear side walls extending rearward from the base wall;

a terminal module comprising a base retained between the top wall and two rear side walls and a mating tongue forwardly extending from the base and going through the retained slot and located between the two front side walls ; and two shielding sheets welded on an upper and a lower faces of the front side walls and the base, thereby defining a mating cavity between the two front side walls and the two shielding sheets and the mating tongue ;

wherein the die-cast outer case is made of die-casting instead of stamping from sheet metal, while the shielding sheets are made from stamping wherein the terminal module is embedded with two rows of terminals and a shielding plate, the shielding plate comprises a main body between the two rows of terminals and two opposite thicken side portions, the side portions further define rear wings which are located behind the base wall; wherein the terminal module is disposed with grounding terminals, the grounding terminals laterally touch inside faces of the side portions and have tabs touching the corresponding lateral wings.

12. The electrical connector as claimed in claim 11, wherein the mating tongue defines a thickened portion at a root thereof near the base, and a pair of shielding collars surrounding an outer periphery of the thickened portion and the shielding plate defines boss portions laterally protruding and contacting the shielding collars.

13. An electrical connector comprising;

a terminal module including a metallic shielding plate located between two rows of terminals in a vertical direction and commonly unitarily formed within an insulative housing which includes a base and a mating tongue forwardly extending from the base in a front-to-back direction perpendicular to said vertical direction, said tongue portion defining two opposite surfaces in the vertical direction and said terminals include contacting sections exposed upon the corresponding surfaces;

a metallic outer case enclosing said terminal module;

an improvement being characterized that said outer case is made of die-casting, instead of stamping from sheet metal, and includes a pair of opposite two side walls each with different thicknesses at different positions in both the vertical direction and a transverse direction perpendicular to both the vertical direction and the front-to-back direction, and said shielding plate is made of die-casting or forging instead of stamping from sheet metal, with a planar main body and two vertically thickened side portions by two lateral sides of the main body in said transverse direction; wherein the main portion forms a plurality of through slots for consideration of insert-molding the terminals and the shielding plate with the insulative housing, and said two vertically thickened side portions form locking notches for engagement with corresponding latches of a complementary plug connector, with different thicknesses at different positions in both the vertical direction and said transverse direction;

wherein the terminals comprise grounding terminals located at outermost positions and laterally touching inside faces of the side portions.

14. The electrical connector as claimed in claim 13, wherein said outer case forms a capsular front mating port without at least one opposite top and bottom walls between said opposite two side walls, but with an additional metallic shielding sheet attached thereto to complete EMI (Electromagnet Interference) shielding in the vertical direction.

15. The electrical connector as claimed in claim 14, wherein the tongue portion extends forwardly beyond both the case and the shielding sheet.

16. The electrical connector as claimed in claim 13, further including a pair of shielding collars attached upon the terminal module and mechanically and electrically connected to the shielding plate.

17. The electrical connector as claimed in claim 13, wherein the thickness of each of said side walls in the transverse direction is gradually increased from a mid-level to either a top level or a bottom level so as to form a capsular front mating port of the outer case.

* * * * *